US008287403B2

(12) United States Patent
Chao et al.

(10) Patent No.: US 8,287,403 B2
(45) Date of Patent: Oct. 16, 2012

(54) IRON-BASED ALLOY FOR A GOLF CLUB HEAD

(75) Inventors: Chih-Yeh Chao, Ping-Tung Hsien (TW); Chuan-Hsien Chang, Ping-Tung Hsien (TW); Jui-Ming Su, Ping-Tung Hsien (TW)

(73) Assignee: O-Ta Precision Industry Co., Ltd., Ping-Tung Hsien (TW)

( * ) Notice: Subject to any disclaimer, the term of this patent is extended or adjusted under 35 U.S.C. 154(b) by 368 days.

(21) Appl. No.: 12/587,835

(22) Filed: Oct. 13, 2009

(65) Prior Publication Data

US 2011/0086726 A1 Apr. 14, 2011

(51) Int. Cl.
*A63B 53/04* (2006.01)
*C22C 38/18* (2006.01)

(52) U.S. Cl. ..... 473/349; 420/34

(58) Field of Classification Search ..... 473/324–350; 148/177–327; 420/34–57
See application file for complete search history.

(56) References Cited

U.S. PATENT DOCUMENTS 3,723,102 A * 3/1973 Lowe ..... 420/34
3,767,385 A * 10/1973 Slaney ..... 420/585
3,837,931 A * 9/1974 Nemoto et al. ..... 148/211
4,041,274 A * 8/1977 Sadowski ..... 219/137 WM
4,082,579 A * 4/1978 Masumoto et al. ..... 148/306
4,086,085 A * 4/1978 McGurty ..... 420/43
4,140,526 A * 2/1979 Moroishi et al. ..... 420/70
4,244,754 A * 1/1981 Masumoto et al. ..... 148/610
4,353,743 A * 10/1982 Vander Voort ..... 420/105
4,444,588 A * 4/1984 Ney, Sr. ..... 420/42
4,637,841 A * 1/1987 Maehara ..... 148/564
4,721,600 A * 1/1988 Maehara et al. ..... 420/57
4,722,755 A * 2/1988 Maehara ..... 148/564
4,917,860 A * 4/1990 Culling ..... 420/49
5,094,812 A * 3/1992 Dulmaine et al. ..... 420/57
5,160,382 A * 11/1992 Smith et al. ..... 148/327
5,183,518 A * 2/1993 Radon ..... 148/324
5,217,545 A * 6/1993 Smith et al. ..... 148/327
5,306,464 A * 4/1994 Culling ..... 420/49
6,048,413 A * 4/2000 Park et al. ..... 148/325
6,220,306 B1 * 4/2001 Omura et al. ..... 138/177
6,514,076 B1 * 2/2003 Bleiweiss et al. ..... 433/102
7,041,002 B2 * 5/2006 Yamamoto ..... 473/324
7,163,593 B2 * 1/2007 Sugawara et al. ..... 148/321
7,186,304 B2 * 3/2007 Chin et al. ..... 148/218
2005/0129563 A1 * 6/2005 Sun et al. ..... 419/38

OTHER PUBLICATIONS

Callister, Jr, William D. Materials Science and Enginnering An Introduction, Fourth Edition. New York: John Wiley & Sons, Inc., copyright 1997., pp. 299-302.*

* cited by examiner

*Primary Examiner* — Alvin Hunter
(74) *Attorney, Agent, or Firm* — Kilpatrick Townsend & Stockton LLP

(57) ABSTRACT

An iron-based alloy for a golf club head includes: chromium in an amount ranging from 16.3 to 17.2 wt %; nickel in an amount ranging from 5.8 to 6.5 wt %; nitrogen in an amount ranging from 0.10 to 0.20 wt %; carbon in an amount ranging from 0.01 to 0.12 wt %; silicon in an amount ranging from 0.3 to 1.2 wt %; manganese in an amount ranging from 0.3 to 1.2 wt %; and a balance of iron and impurities, based on a total weight of the iron-based alloy. The alloy has a duplex-phase microstructure including a martensite phase and 10 to 30 percent austenite phase, and has a tensile strength greater than 120 Ksi and an elongation greater than 35%.

2 Claims, 5 Drawing Sheets

| METHOD | MATERIAL | YIELD STRENGTH (ksi) | TENSILE STRENGTH (ksi) | DUCTILITY (%) | HARDNESS | HEAT TREATMENT |
|---|---|---|---|---|---|---|
| CASTING | 17-4PH | 87 | 123 | 23 | HRc30 | 1030°C FOR 1 HOUR, 720°C FOR 5 HOURS |
| | 431SS | 94 | 107 | 22 | HRc20 | 720°C FOR 3 HOURS |
| | 304SS | 30 | 75 | 40 | RB88 | 1030°C FOR 1 HOUR |
| | PURE TITANIUM | 62 | 70 | 18 | - | ANNEALING |
| | Ti-6Al-4V | 125 | 135 | 12 | HRc34 | SOLID SOLUTION AND AGING TREATMENTS |
| | N60 | 85 | 115 | 35 | HV280 | ANNEALING |
| | AM350 | 125 | 160 | 30 | HV250 | ANNEALING |
| FORGING OR ROLLING | 450SS | 169 | 181 | 16 | HV340 | SOLID SOLUTION AND AGING TREATMENTS |
| | 15-5 | 170 | 200 | 14 | HV350 | SOLID SOLUTION AND AGING TREATMENTS |
| | 17-7 | 175 | 200 | 9 | HV370 | SOLID SOLUTION AND AGING TREATMENTS |
| | 455SS | 195 | 235 | 12 | HV380 | SOLID SOLUTION, DEEP COOLING, AND AGING TREATMENTS |
| | 465SS | 215 | 260 | 14 | HV515 | SOLID SOLUTION, DEEP COOLING, AND AGING TREATMENTS |
| | 475SS | 230 | 290 | 6 | HV525 | SOLID SOLUTION, DEEP COOLING, AND AGING TREATMENTS |
| | 304SS | 32 | 72 | 64 | HV180 | ANNEALING |
| | S25C | 44 | 80 | 31 | RB82 | ANNEALING |
| | 17-4PH | 145 | 170 | 16 | HV330 | SOLID SOLUTION AND AGING TREATMENTS |
| | Ti-6Al-4V | 153 | 163 | 14 | HRc36 | ANNEALING |

FIG. 1
PRIOR ART

IRON-BASED ALLOY FOR A GOLF CLUB HEAD

BACKGROUND OF THE INVENTION

1. Field of the Invention

The invention relates to an iron-based alloy, more particularly to an iron-based alloy for a golf club head.

2. Description of the Related Art

A golf club set usually consists of several golf clubs including a driver, a putter, woods, irons, etc.

Usually, the iron clubs are made of titanium alloy, low carbon steel, or stainless steels.

FIGS. 1 and 2 show the available materials for the commercial iron clubs. For example, the iron club made of low carbon steel (S25C) possesses a good elongation greater than 30% and an ultimate tensile strength in the range of 100-120 ksi. Because the low carbon steel (S25C) iron club is soft (i.e., the low carbon steel (S25C) iron club is provided with a higher elongation), it results in a soft feel when hitting a golf ball and facilitates adjustment of angles of the iron club head (for example, a loft angle). However, the iron club made of low carbon steel club is susceptible to deformation and rusting. Therefore, the iron club head made of low carbon steel (S25C) further requires a surface treatment, such as Ni and/or Cr coating.

On the other hand, although the iron club made of stainless 475 (475SS) has a relatively higher tensile strength (about 290 Ksi), the elongation thereof is small (6%), and results in a hard feel when hitting a golf ball. Thus, it is hard to either offer a soft feel or adjust a loft angle of the golf club head.

SUMMARY OF THE INVENTION

Therefore, an object of the present invention is to provide an iron-based alloy for a golf club head that has both improved tensile strength and elongation so as to obtain a soft feel when hitting a golf ball, and to obtain a golf club head which has a loft angle that does not easily change. In addition, the golf club head does not require any surface treatment.

Accordingly, in a first aspect of the present invention, an iron-based alloy for a golf club head comprises:

chromium in an amount ranging from 16.3 to 17.2 wt %;

nickel in an amount ranging from 5.8 to 6.5 wt %;

nitrogen in an amount ranging from 0.10 to 0.20 wt %;

carbon in an amount ranging from 0.01 to 0.12 wt %;

silicon in an amount ranging from 0.3 to 1.2 wt %;

manganese in an amount ranging from 0.3 to 1.2 wt %; and a balance of iron and impurities, based on a total weight of the iron-based alloy; and wherein:

the alloy has a duplex-phase microstructure including a martensite phase and 10~30% austenite phase and possesses a tensile strength greater than 120 Ksi and an elongation greater than 35%.

Preferably, the duplex-phase microstructure of the iron-based alloy in the first aspect of the present invention is formed as a result of a solid solution treatment under 950~1150° C. for 0.5~2 hours.

In a second aspect of the present invention, an iron-based alloy for a golf club head comprises:

chromium in an amount ranging from 16.3 to 17.2 wt %;

nickel in an amount ranging from 5.8 to 6.5 wt %;

nitrogen in an amount ranging from 0.10 to 0.20 wt %;

carbon in an amount ranging from 0.01 to 0.12 wt %;

silicon in an amount ranging from 0.3 to 1.2 wt %;

manganese in an amount ranging from 0.3 to 1.2 wt %;

copper in an amount ranging from 2.8 to 3.2 wt %;

titanium, niobium, and vanadium in an amount ranging from 0.15 to 0.5 wt %; and a balance of iron and impurities, based on a total weight of the iron-based alloy; and wherein:

the alloy has a duplex-phase microstructure including a martensite phase and 10~30% austenite phase, and possesses a tensile strength greater than 120 Ksi and an elongation greater than 35%.

Preferably, the duplex-phase microstructure of the iron-based alloy in the second aspect of the present invention is formed as a result of a solid solution treatment under 950~1150° C. for 0.5~2 hours, followed by an aging treatment under 450~600° C.

BRIEF DESCRIPTION OF THE DRAWINGS

Other features and advantages of the present invention will become apparent in the following detailed description of the preferred embodiments with reference to the accompanying drawings, of which:

FIG. 1 illustrates materials and properties of commercially available iron clubs.

FIG. 4(*b*) shows a selected area diffraction pattern of martensite phase under a camera length of $8.7\times10^8$ nm. In FIG. 4(*b*), the foil normal is [111], and the structure of the martensite is a body-center cubic (B.C.C.) with a lattice parameter (a) of 0.287 nm.

FIG. 5(*b*) shows a selected area diffraction pattern of austenite phase under a camera length of $8.7\times10^8$ nm. In FIG. 5(*b*), the foil normal is [001], and the structure of the austenite is a face-center cubic (F.C.C.) with a lattice parameter (a) of 0.287 nm.

DETAILED DESCRIPTION OF THE PREFERRED EMBODIMENTS

First Embodiment

Figure 2:
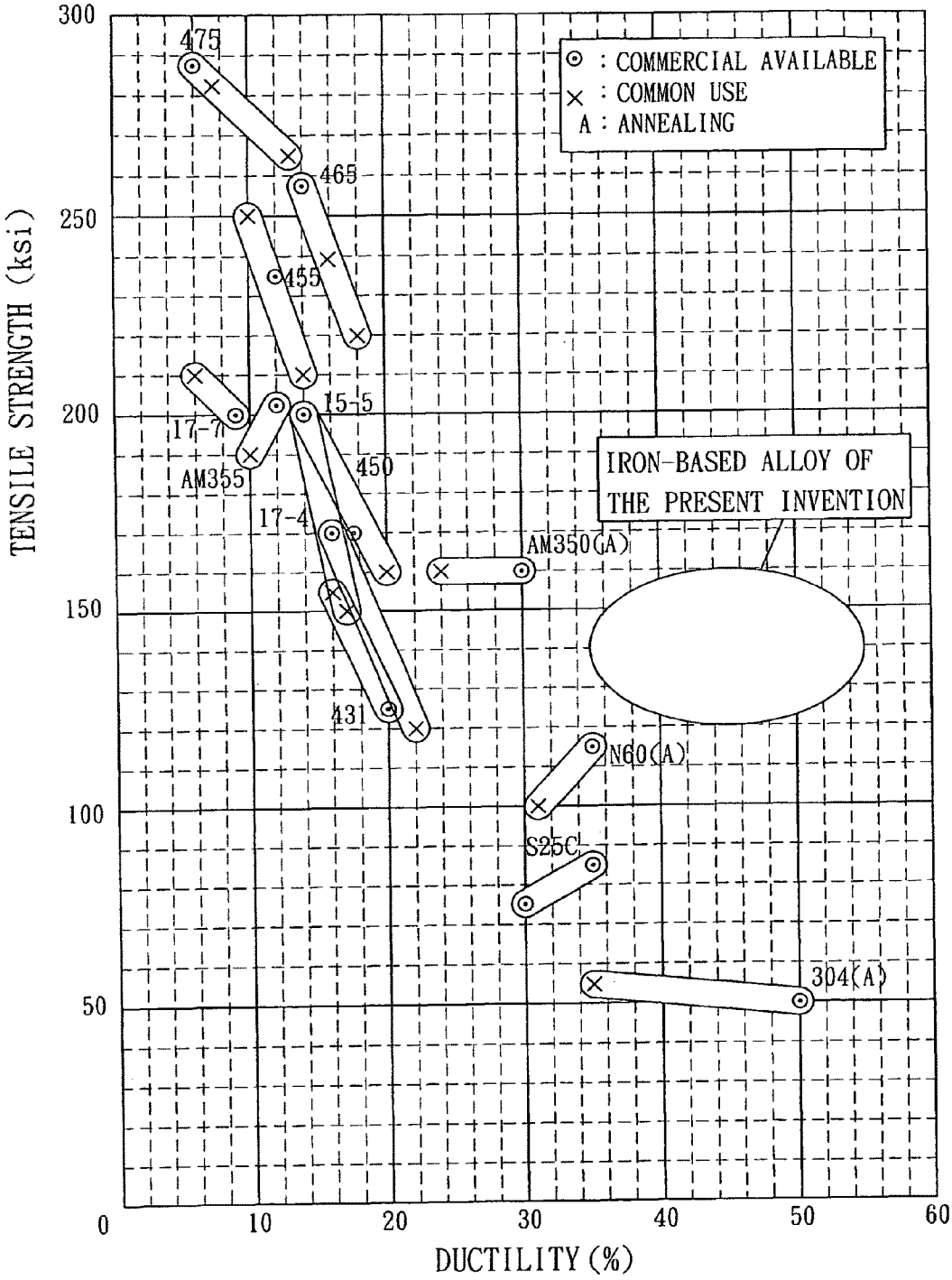
FIG. 2 shows relationship between tensile strength and ductility among materials of commercially available iron clubs and the iron-based alloy of the present invention.

The iron-based alloy for a golf club head according to the first embodiment of this invention preferably comprises:

chromium in an amount ranging from 16.3 to 17.2 wt %; nickel in an amount ranging from 5.8 to 6.5 wt %; nitrogen in an amount ranging from 0.10 to 0.20 wt %; carbon in an amount ranging from 0.01 to 0.12 wt %; silicon in an amount ranging from 0.3 to 1.2 wt %; manganese in an amount ranging from 0.3 to 1.2 wt %; and a balance of iron and impurities, based on a total weight of the iron-based alloy.

The alloy of the first embodiment has a duplex-phase microstructure including martensite and 10 to 30 percent austenite, and has a tensile strength ranging from 130~145 Ksi, a yield strength ranging from 70~90 Ksi, and a ductility ranging from 35~55%.

The duplex-phase microstructure of the alloy of the first embodiment is formed as a result of a solid solution treatment under 950~1150° C. for 0.5~2 hours.

Addition of chromium into the iron-based alloy increases the corrosion resistance and the oxidation resistance of the iron-based alloy. In order to easily control the duplex-phase microstructure to possess a martensite phase and 10~30% austenite phase for better performance of a golf club head, the chromium amount in the iron-based alloy should range from 16.3 to 17.2 wt %.

Addition of nickel into the iron-based alloy is mainly for controlling the microstructure of the alloy. If the nickel amount in the iron-based alloy is lower than 5.8 wt %, the golf club head made of the iron-based alloy will have a relatively unstable austenitic phase, and thus, an alloy with an unsatisfactory elongation (lower than 35%) would be obtained. If the nickel amount in the iron-based alloy is higher than 6.5 wt %, although the austenitic phase can be stabilized, the tensile strength of the alloy will be insufficient, and thus, the golf club head made of the iron-based alloy will have unsatisfactory mechanical properties. In order to easily control the duplex-phase microstructure to possess a martensite phase and 10 to 30 percent austenite phase so as to obtain a golf club head having superior performance, the nickel amount in the iron-based alloy should be in the range from 5.8 wt % to 6.5 wt %.

Addition of nitrogen not only stabilizes the austenitic phase, but also makes the iron-based alloy to have satisfactory elongation. If the amount of the nitrogen in the iron-based alloy is lower than 0.10 wt %, the golf club head made of the iron-based alloy will have a relatively unstable austenitic phase such that an alloy with an unsatisfactory elongation (lower than 35%) would be obtained. If the amount of the nitrogen in the iron-based alloy is higher than 0.20 wt %, the alloy will become brittle since a lot of gas will be released during a casting process of the golf club head. Accordingly, the amount of nitrogen in the iron-based alloy should be in the range from 0.10 wt % to 0.20 wt %.

Carbon is an essential element in a steel material. Carbon may exist in an alloy in the form of carbides and is also a necessary element to stabilize the martensite phase. However, if the amount of carbon in the iron-based alloy is excessive, the amount of carbides will increase and thus, the corrosion resistance of the iron-based alloy will be unsatisfactory, and the weld-ability and the mechanical properties of the iron-based alloy will be poor. Therefore, in order for the iron-based alloy to have satisfactory corrosion resistance and a stable martensite phase, the amount of carbon in the iron-based alloy should range from 0.01 wt % to 0.12 wt %.

Addition of silicon into the iron-based alloy has advantages of preventing the formation of pores, enhancing shrinkability, and increasing the fluidity of molten steel. If the silicon amount in the iron-based alloy ranges from 0.3 wt % to 1.2 wt %, it is beneficial for improving the castability of the iron-based alloy.

Manganese usually co-exists with iron. Since manganese can be combined with sulfur easily, the thermal brittleness of the iron-based alloy due to the presence of sulfur can be eliminated. Furthermore, the oxide in the iron-based alloy can be removed by manganese. Additionally, the martensite phase can be stabilized by manganese. Therefore, addition of manganese into the iron-based alloy in an amount of greater than 0.3 wt % and not more than 1.2 wt % can eliminate the thermal brittleness of the iron-based alloy and improve the castability of the iron-based alloy.

Second Embodiment

The iron-based alloy for a golf club head according to the second embodiment of this invention preferably comprises: chromium in an amount ranging from 16.3 to 17.2 wt %; nickel in an amount ranging from 5.8 to 6.5 wt %; nitrogen in an amount ranging from 0.10 to 0.20 wt %; carbon in an amount ranging from 0.01 to 0.12 wt %; silicon in an amount ranging from 0.3 to 1.2 wt %; manganese in an amount ranging from 0.3 to 1.2 wt %; copper in an amount ranging from 2.8 to 3.2 wt %; titanium, niobium, and vanadium in an amount ranging from 0.15 to 0.5 wt %; and a balance of iron and impurities, based on a total weight of the iron-based alloy.

The alloy of the second embodiment has a duplex-phase microstructure including the martensite phase and 10 to 30 percent austenite phase, and has a tensile strength ranging from 120~160 Ksi, a yield strength ranging from 60~100 Ksi, and an elongation in the range of 35~55%.

The duplex-phase microstructure of the alloy of the second embodiment is formed as a result of a solid solution treatment under 950~1150° C. for 0.5~2 hours, followed by an aging treatment under 450~600° C.

In the second embodiment, the reasons for the addition of chromium, nickel, nitrogen, carbon, silicon, and manganese are the same as those in the first embodiment. The reasons for the addition of copper, titanium, niobium, and vanadium are as follows.

Copper is used to enhance the overall mechanical properties of the golf club head made of the iron-based alloy of the present invention. If the copper amount in the iron-based alloy is lower than 2.8 wt %, the overall mechanical properties for the golf club head will be insufficient. If the copper amount in the iron-based alloy is greater than 3.2 wt %, the corrosion resistance for the golf club head will be unsatisfactory. The amount of copper in the iron-based alloy preferably ranges from 2.8 wt % to 3.2 wt %.

Titanium, niobium, and vanadium are used to make the grain size of the alloy finer, and are able to intensify the overall mechanical properties of the golf club head made of the alloy by an aging treatment. If the amount of (titanium+niobium+vanadium) in the iron-based alloy ranges from 0.15 wt % to 0.50 wt %, it is beneficial for improving the mechanical properties in the casting process of the iron-based alloy.

Examples

The iron-based alloy of the present invention can be used to manufacture a golf club head using a well-known casting process in the art.

For example, a casting process comprises steps of: preparing a wax mold in the same shape of the golf club head, dipping the wax mold in a slurry of casting sand to form a casting mold, removing the wax mold from the casting mold, melting and mixing each of contents in Table 1 and putting them into the casting mold with an appropriate heat treatment as the conditions stated in Table 1 to control the duplex-phase microstructure to include a martensite phase and 10 to 30 percent austenite phase, breaking the casting mold and taking out the alloy, and rubbing the surface of the alloy. After measuring the tensile strength, the yield strength, and ductility of each of examples and comparative examples, data are respectively recorded in Table 1. Examples 1~4 are the golf club head made of the alloy of the first embodiment. Examples 5~12 are the golf club head made of the alloy of the second embodiment. Comparative examples 1~4 are the golf club head made of the alloy outside of the preferred ranges of this invention.

As shown in Table 1, each of the golf club heads made of the alloy according to the first and second embodiments has a tensile strength greater than 120 Ksi, and a ductility greater than 35% (also see the tensile strength and the ductility of the alloys according to this invention in FIG. 2). Particularly, by controlling the amount of nitrogen in the alloy according to this invention to be in a range from 0.10 wt % to 0.20 wt %, the alloy of this invention has superior ductility than that of the comparative examples 1~4.

Figure 3:
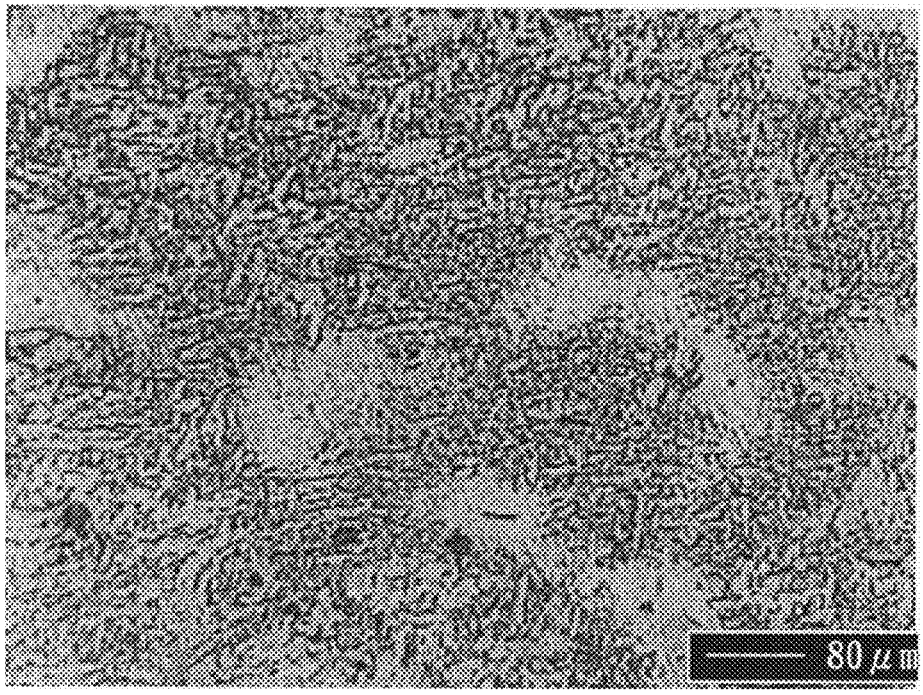
FIG. 3 shows an optical micrograph, at a magnification of 100 times, of a cast golf club head formed from example 1 of an iron-based alloy according to this invention.

FIG. 3 shows an optical metallograph of a cast golf club head formed from the example 1 of an iron-based alloy according to this invention, and a duplex-phase microstructure including acicular martensite and massive austenite can be observed.

Figure 4A:
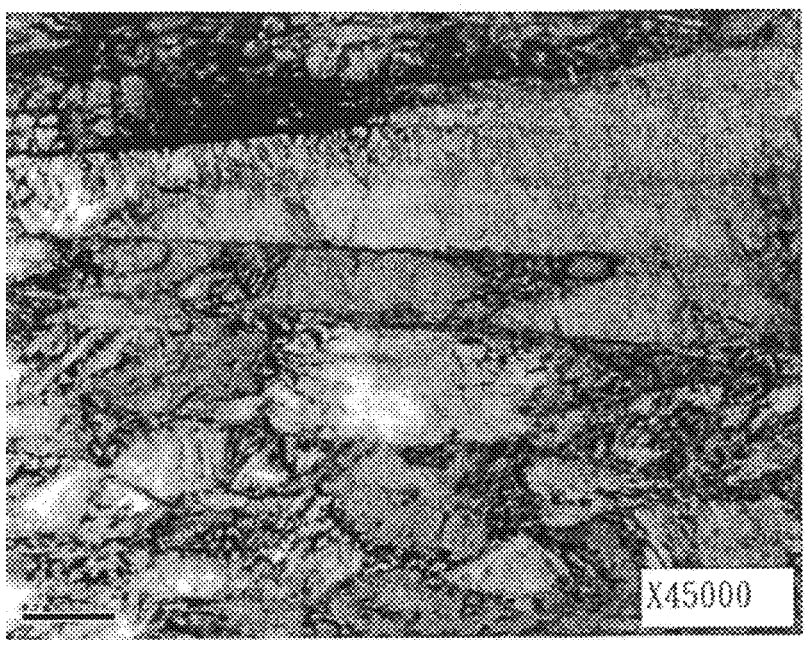
FIG. 4(*a*) shows a transmission electron micrograph, at a magnification of 45000 times, of martensite phase in FIG. 3 for illustrating some dislocations within a lamellar martensite matrix.
Figure 4B:
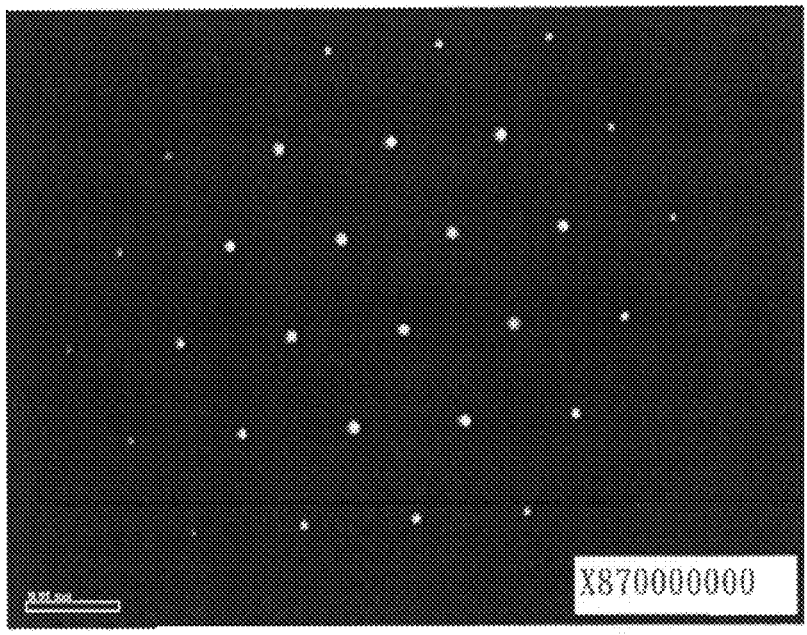
Figure 5A:
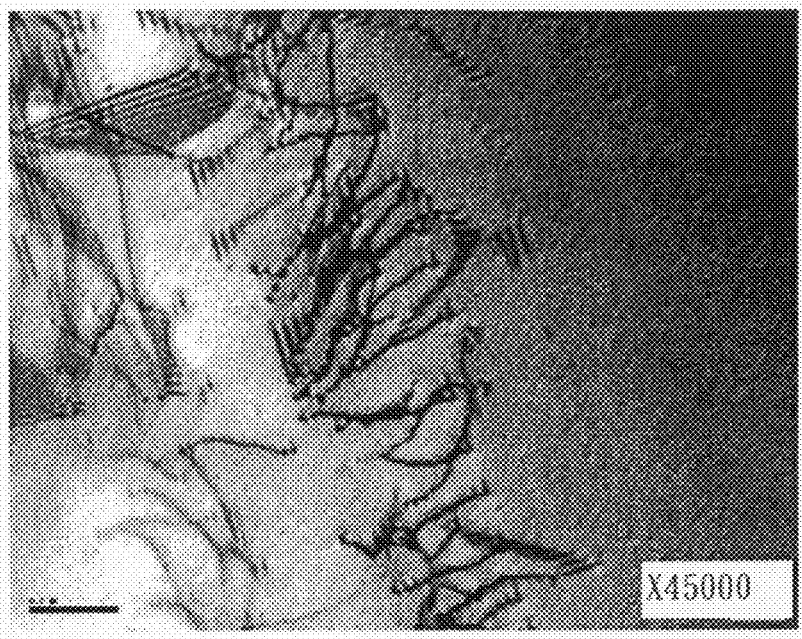
FIG. 5(*a*) shows a transmission electron micrograph, at a magnification of 45000 times, of austenite phase in FIG. 3 for illustrating some dislocations within the austenite matrix.
Figure 5B:
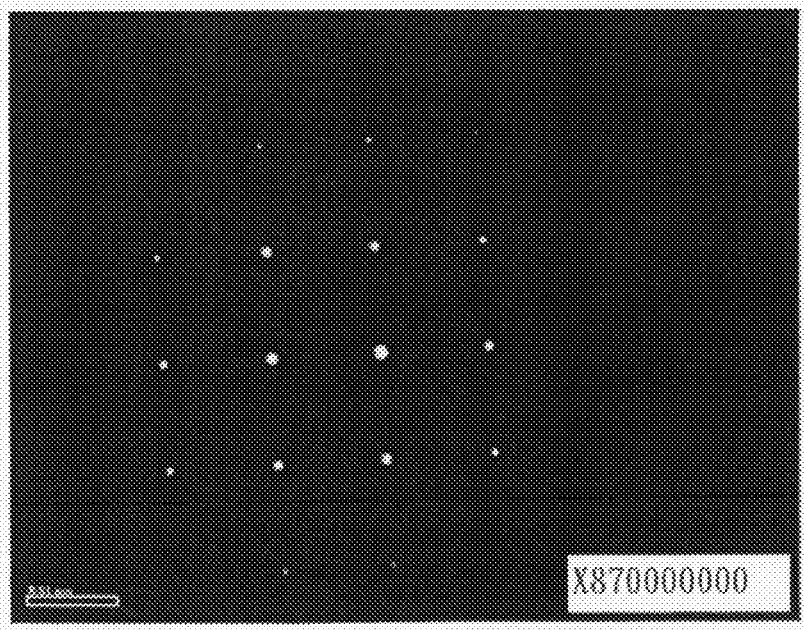

For further observation of the microstructure of the alloy in the example 1, the duplex-phase microstructure including martensite (see the transmission electron micrograph in FIG. 4(*a*) and the selected area diffraction pattern in FIG. 4(*b*)) and austenite (see the transmission electron micrograph in FIG. 5(*a*) and the selected area diffraction pattern in FIG. 5(*b*)) can be confirmed.

It should be noted that all of the alloys in the first and second embodiments could pass the salt spray test and the hitting-ball test.

The salt spray test is used to check the corrosion resistance of the alloy and is conducted at 40±5° C. using a nozzle that sprays a solution containing 5% sodium chloride on the alloy. The alloys of the first and second embodiments are without appearance of corrosion after testing for 48 hours.

The golf club heads made of the alloys according to the first and second embodiments can hit golf balls for over 3000 times without any de format ion, and thus, should satisfy the requirement of the mechanical properties for the golf club head.

In view of the aforesaid, by controlling each component in the alloy (especially the amount of nitrogen in the alloy) according to this invention in the limited ranges, the duplex-phase microstructure including martensite phase and 10 to 30 percent austenite phase can be formed, such that the tensile strength and the elongation of the alloy according to this invention can be improved, such that the golf club head made of the alloy of this invention can offer a soft feel when hitting a golf ball and provide sufficient mechanical properties, and such that a surface treatment is not required.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

TABLE 1

| | Components (wt %) | | | | | | | | | Mechanical properties | | | |
|---|---|---|---|---|---|---|---|---|---|---|---|---|---|
| | Cr | Ni | N | Si | Mn | C | Cu | Ti + Nb + V | Fe | Tensile strength (Ksi) | Yield strength (Ksi) | Elongation (%) | Heating treatment |
| Example 1 | 16.53 | 6.51 | 0.16 | 0.67 | 0.78 | 0.03 | — | — | Bal. | 132.15 | 75.72 | 47.56 | 1000° C./1 Hour |
| Example 2 | 16.72 | 5.98 | 0.15 | 0.78 | 0.36 | 0.06 | — | — | Bal. | 136.29 | 79.64 | 43.58 | 1000° C./1 Hour |
| Example 3 | 16.65 | 6.23 | 0.14 | 0.75 | 0.76 | 0.08 | — | — | Bal. | 140.18 | 84.47 | 42.23 | 1100° C./1 Hour |
| Example 4 | 16.62 | 6.39 | 0.12 | 0.55 | 0.32 | 0.11 | — | — | Bal. | 143.20 | 90.48 | 38.77 | 1100° C./1 Hour |
| Example 5 | 16.70 | 5.82 | 0.17 | 0.43 | 0.38 | 0.05 | 3.19 | 0.19 | Bal. | 149.62 | 95.71 | 38.58 | 1000° C./1 Hour + Aging 450° C. |
| Example 6 | 16.52 | 6.07 | 0.16 | 0.36 | 0.45 | 0.09 | 3.15 | 0.25 | Bal. | 152.39 | 98.79 | 36.92 | 1100° C./1 Hour + Aging 450° C. |
| Example 7 | 16.55 | 6.08 | 0.15 | 0.33 | 0.32 | 0.03 | 3.07 | 0.28 | Bal. | 143.42 | 83.25 | 42.81 | 1000° C./1 Hour + Aging 500° C. |
| Example 8 | 16.44 | 5.92 | 0.17 | 0.38 | 0.57 | 0.04 | 2.98 | 0.25 | Bal. | 147.68 | 87.36 | 41.28 | 1100° C./1 Hour + Aging 500° C. |
| Example 9 | 17.12 | 5.91 | 0.15 | 0.47 | 0.43 | 0.09 | 3.11 | 0.24 | Bal. | 132.12 | 82.67 | 47.01 | 1000° C./1 Hour + Aging 550° C. |
| Example 10 | 16.57 | 6.05 | 0.16 | 0.42 | 0.71 | 0.06 | 2.96 | 0.18 | Bal. | 135.82 | 81.29 | 45.37 | 1100° C./1 Hour + Aging 550° C. |
| Example 11 | 16.47 | 5.60 | 0.17 | 0.57 | 0.64 | 0.06 | 3.20 | 0.27 | Bal. | 122.31 | 72.54 | 50.31 | 1000° C./1 Hour + Aging 600° C. |
| Example 12 | 16.54 | 6.31 | 0.16 | 0.50 | 0.38 | 0.05 | 3.12 | 0.16 | Bal. | 126.03 | 77.41 | 49.81 | 1100° C./1 Hour + Aging 600° C. |
| Comp. Ex. 1 | 17.25 | 6.75 | 0.04 | 0.40 | 0.43 | 0.07 | — | | Bal. | 175.44 | 120.34 | 17.76 | 1000° C./1 Hour |
| Comp. Ex. 2 | 16.73 | 6.21 | 0.07 | 0.54 | 0.58 | 0.15 | — | | Bal. | 161.33 | 110.44 | 20.67 | 1000° C./1 Hour |
| Comp. Ex. 3 | 16.11 | 6.01 | 0.08 | 0.61 | 0.47 | 0.04 | — | | Bal. | 152.03 | 102.72 | 23.45 | 1000° C./1 Hour |
| Comp. Ex. 4 | 15.98 | 5.55 | 0.11 | 0.62 | 0.36 | 0.13 | — | | Bal. | 152.90 | 103.11 | 21.55 | 1000° C./1 Hour |

[Aging]: Aging treatment

We claim:

1. An iron-based alloy for a golf club head, comprising:

chromium in an amount ranging from 16.3 to 17.2 wt %;

nickel in an amount ranging from 5.8 to 6.5 wt %;

nitrogen in an amount ranging from 0.10 to 0.20 wt %;

carbon in an amount ranging from 0.01 to 0.12 wt %;

silicon in an amount ranging from 0.3 to 1.2 wt %;

manganese in an amount ranging from 0.3 to 1.2 wt %;

copper in an amount ranging from 2.8 to 3.2 wt %;

titanium, niobium, and vanadium in an amount ranging from 0.15 to 0.5 wt %; and a balance of iron and impurities, based on a total weight of said iron-based alloy; and wherein:

said alloy has a duplex-phase microstructure including a martensite phase and 10~30% austenite phase, and possesses a tensile strength greater than 120 Ksi and an elongation greater than 35%.

2. The iron-based alloy of claim 1, wherein the duplex-phase microstructure is formed as a result of a solid solution treatment under 950~1150° C. for 0.5~2 hours, followed by an aging treatment under 450~600° C.

* * * * *